US008350174B2

(12) United States Patent
Gentsch

(10) Patent No.: US 8,350,174 B2
(45) Date of Patent: Jan. 8, 2013

(54) POLE PART OF A MEDIUM-VOLTAGE OR HIGH-VOLTAGE SWITCH GEAR ASSEMBLY, AND METHOD FOR ITS PRODUCTION

(75) Inventor: Dietmar Gentsch, Ratingen (DE)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 12/977,829

(22) Filed: Dec. 23, 2010

(65) Prior Publication Data

US 2011/0120976 A1 May 26, 2011

Related U.S. Application Data

(63) Continuation of application No. PCT/EP2009/004541, filed on Jun. 24, 2009.

(30) Foreign Application Priority Data

Jun. 24, 2008 (EP) ..... 08011391

(51) Int. Cl.
*H01H 33/66* (2006.01)

(52) U.S. Cl. ..... 218/124; 218/154

(58) Field of Classification Search ..... 218/154, 218/123–126
See application file for complete search history.

(56) References Cited

U.S. PATENT DOCUMENTS 4,618,749 A 10/1986 Boehme et al.
5,753,875 A * 5/1998 Benke et al. ..... 218/118
6,130,394 A * 10/2000 Hogl ..... 218/138
6,310,310 B1 * 10/2001 Wristen ..... 218/121
7,115,831 B2 * 10/2006 Chyla et al. ..... 218/124
7,285,743 B2 * 10/2007 Martin ..... 218/138
7,304,262 B2 * 12/2007 Stoving et al. ..... 218/120
7,852,180 B2 * 12/2010 Gentsch et al. ..... 335/201
7,910,852 B2 * 3/2011 Chen et al. ..... 218/153
2004/0232113 A1 11/2004 Kynast et al.

(Continued)

FOREIGN PATENT DOCUMENTS

JP 2008-010171 A 1/2008

(Continued)

OTHER PUBLICATIONS

*International Search Report (PCT/ISA/210) issued on Sep. 4, 2009, by European Patent Office as the International Searching Authority for International Application No. PCT/EP2009/004541.

*Primary Examiner* — Truc Nguyen
(74) *Attorney, Agent, or Firm* — Buchanan Ingersoll & Rooney PC

(57) ABSTRACT

A pole part of a switchgear assembly having a vacuum interrupter chamber is provided. To ensure that heat is dissipated to the exterior for convection, a thermally conductive heat transmission element in the form of a cylindrical casing is provided between the vacuum interrupter chamber, a contact holder and an encapsulation casing. An inner surface of the heat transmission element rests on the vacuum interrupter chamber and the contact holder, and an outer surface of the heat transmission element rests on an inner surface of the encapsulation casing inner surface. The heat transmission element can be produced from a thermally conductive plastic using an injection-molding or molding-compound production process. The heat transmission element can be connected to the pole part through openings. The heat transmission element can be arranged before the encapsulation of with an encapsulation compound, and be cast in the encapsulation casing.

27 Claims, 3 Drawing Sheets

U.S. PATENT DOCUMENTS

| | | | | |
|---|---|---|---|---|
| 2006/0011589 | A1 | 1/2006 | Hering et al. | |
| 2006/0096856 | A1 * | 5/2006 | Martin | 204/298.21 |
| 2008/0041825 | A1 * | 2/2008 | Stoving et al. | 218/120 |
| 2008/0087647 | A1 * | 4/2008 | Volkmar | 218/134 |

FOREIGN PATENT DOCUMENTS

| | | | |
|---|---|---|---|
| WO | WO 03/017306 | A | 2/2003 |
| WO | WO 2004/038748 | A1 | 5/2004 |

* cited by examiner

POLE PART OF A MEDIUM-VOLTAGE OR HIGH-VOLTAGE SWITCH GEAR ASSEMBLY, AND METHOD FOR ITS PRODUCTION

RELATED APPLICATIONS

This application claims priority as a continuation application under 35 U.S.C. §120 to PCT/EP2009/004541, which was filed as an International Application on Jun. 24, 2009 designating the U.S., and which claims priority to European Application 08011391.3 filed in Europe on Jun. 24, 2008. The entire contents of these applications are hereby incorporated by reference in their entireties.

FIELD

The present disclosure relates to a pole part for a medium-voltage or high-voltage switchgear assembly, and to a method for producing such a pole part.

BACKGROUND INFORMATION

Pole parts for medium-voltage or high-voltage switchgear assemblies must have a high current carrying capacity. In this case, contact resistances are kept as low as possible. The high currents that flow in the connected state (load case) may, however, produce significant amounts of thermal energy, even when the contact resistances are low. The produced thermal energy must be dissipated in a suitable manner.

For reasons relating to dielectric hermetic sealing of such a pole part, the vacuum interrupter chambers can be composed of ceramic having a low thermal conductivity. In this arrangement, the majority of the thermal energy is dissipated out of the chamber by the supply lines (generally composed of copper material), and is concentrated in this area. The vacuum interrupter chamber is encapsulated overall in an electrically insulating encapsulation casing. The electrical insulation characteristic of the encapsulation casing can also reduce the heat transmission.

SUMMARY

An exemplary embodiment provides a pole part of a switchgear assembly. The exemplary pole part includes a vacuum interrupter chamber, which is encapsulated in an external encapsulation casing, is composed of a composite material, and is closed at both ends by metallic cover elements. The exemplary pole part also includes a contact holder, and a thermally conductive heat transmission element. The thermally conductive heat transmission element is in the form of a cylindrical casing, has an inner surface and an outer surface, and is provided between the vacuum interrupter chamber, the contact holder and the encapsulation casing. The inner surface of the heat transmission element rests on or in the vicinity of an outer surface of the vacuum interrupter chamber and the contact holder, and the outer surface of the heat transmission element rests on an inner surface of the encapsulation casing inner surface or is located within the encapsulation casing.

An exemplary embodiment provides a method for producing a pole part of a switchgear assembly having a vacuum interrupter chamber, which is encapsulated in an external encapsulation casing, is composed of a composite material, and is closed at both ends by metallic cover elements. The exemplary method includes arranging a heat transmission element on the vacuum interrupter chamber before the vacuum interrupter chamber is encapsulated in the external encapsulation casing. The arranging of the heat transmission element includes fitting the heat transmission element to an outer surface of the vacuum interrupter chamber, and surrounding or extrusion coating the fitted heat transmission element with the encapsulation casing compound.

An exemplary embodiment provides a method for producing a pole part of a switchgear assembly having a vacuum interrupter chamber, which is encapsulated in an external encapsulation casing, is composed of a composite material, and is closed at both ends by metallic cover elements. The exemplary method includes producing a heat transmitter composed of a thermally conductive plastic using at least one of an injection-molding, casting and molding compound process. In addition, the exemplary method includes applying the produced heat transmitter to the pole part by encapsulating the heat transmitter in the encapsulation casing compound.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Exemplary embodiments of the present disclosure provide an improved pole part, and a method for producing such a pole part, such that heat that is created is dissipated better to the outside for convection.

In accordance with an exemplary embodiment, an electrically insulating or else conductive (and in consequence thermally conductive) heat transmission element, which is in the form of a cylindrical casing, is provided between the vacuum interrupter chamber and the encapsulation casing. An inner surface of the heat transmission element rests on a contact holder which passes on the thermal flow from here so that, with its outer surface, the thermal conduction on the encapsulation casing inner surface can be transmitted over a large area to the insulation material. According to an exemplary embodiment, the contact holder dissipates the heat flow from one of the two supply lines of a vacuum interrupter chamber outwards, passes the rated current via the connections to the outside, constitutes an interface to the pole part, and passes on the thermal flow from here such that, with its outer surface, the thermal conduction on the encapsulation casing inner surface can be transmitted over a large area to the insulation material. Accordingly, the thermal coupling element can be located between a metal part and an insulator which is made of a thermally conductive material.

The thermal conductive element can also be suited for injection molding and can be embedded within a second molding process.

In comparison to the known pole parts mentioned above, in which the vacuum interrupter chamber is directly encapsulated in the encapsulation compound or is encapsulated with the injection-molding compound, exemplary embodiments of the present disclosure provide that a thermally conductive heat transmission element in the form of a cylindrical casing will transmit between the contact holder on which the current and heat transmission from the vacuum interrupter chamber predominantly takes place to the thermally conductive heat transmitter element, and therefore, via the casing outer surface to the pole part material, the encapsulation casing. This arrangement creates a larger, and in particular effective, thermally transmissive (conductive) intermediate layer. This arrangement also effectively increases the thermal power transported from the inside outwards and likewise enlarges the heat transmitter area on the outside of the pole part.

Figure 1:
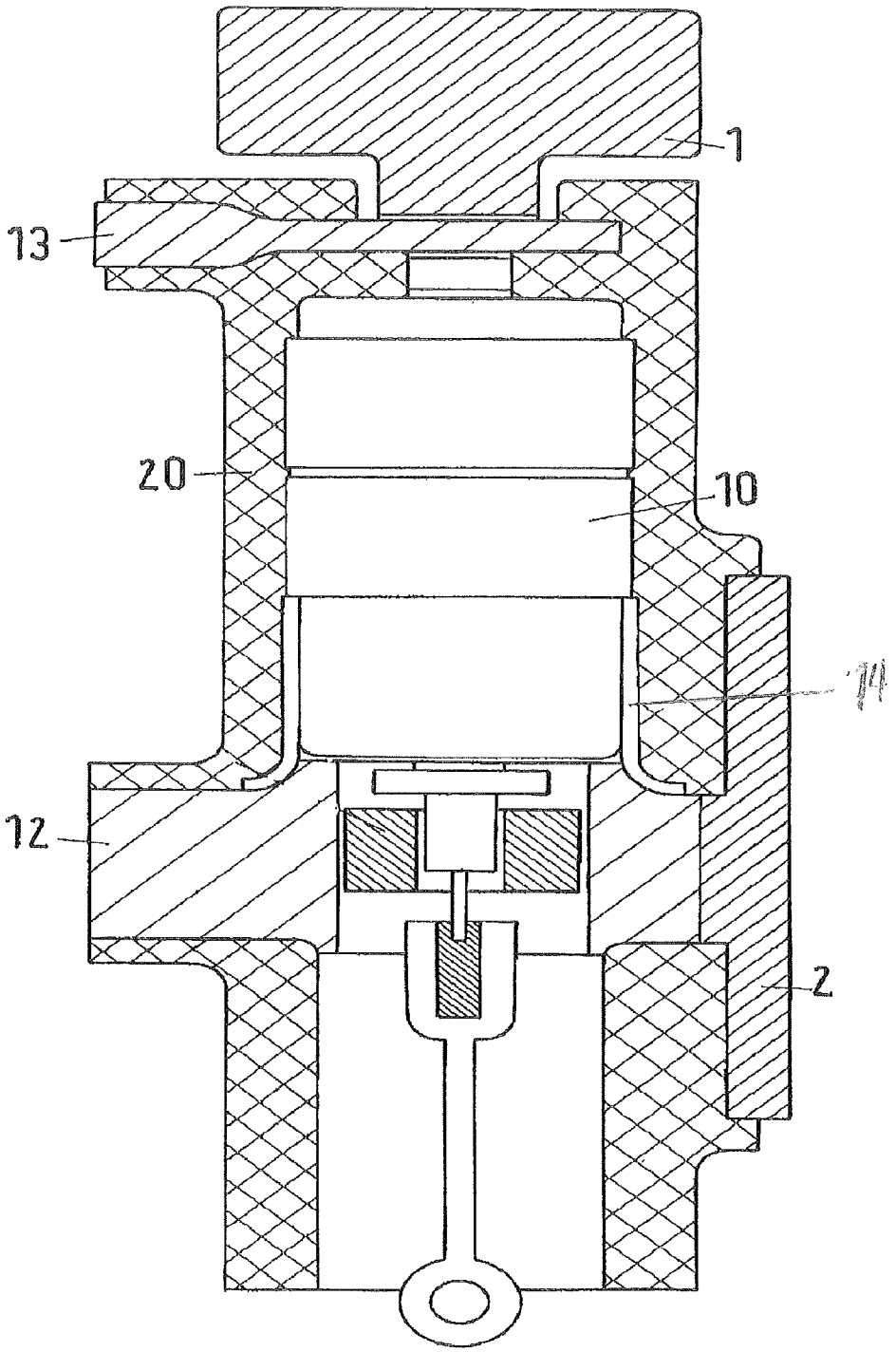
FIG. 1 shows an exemplary pole part used in a medium-voltage or high-voltage switchgear assembly, according to an embodiment of the present disclosure.

In accordance with an exemplary embodiment, the outer surface of the heat transmission element 14, which is in the form of a cylindrical casing, can be folded (FIG. 1). This arrangement considerably increases the effective area for heat transmission on the side of the encapsulation casing.

Figure 2:
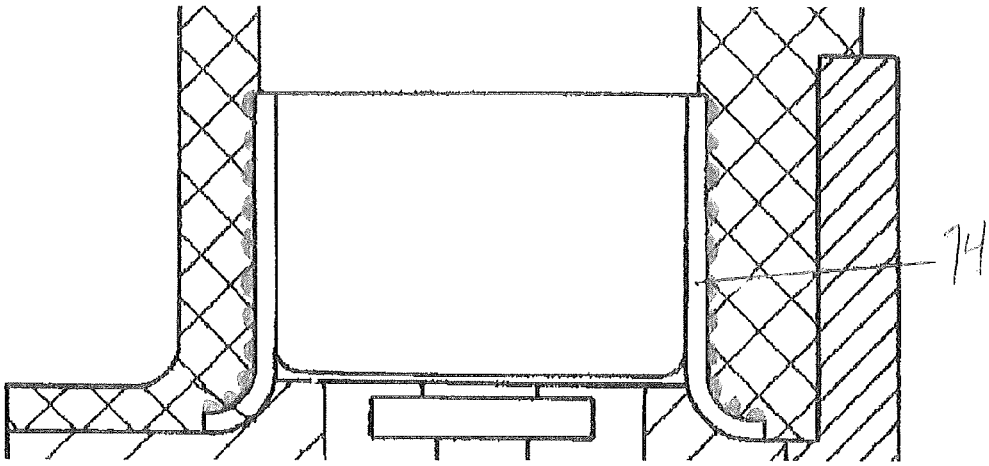
FIG. 2 illustrates an exemplary heat transmission element having a corrugated surface according to an embodiment of the present disclosure.
Figure 3:
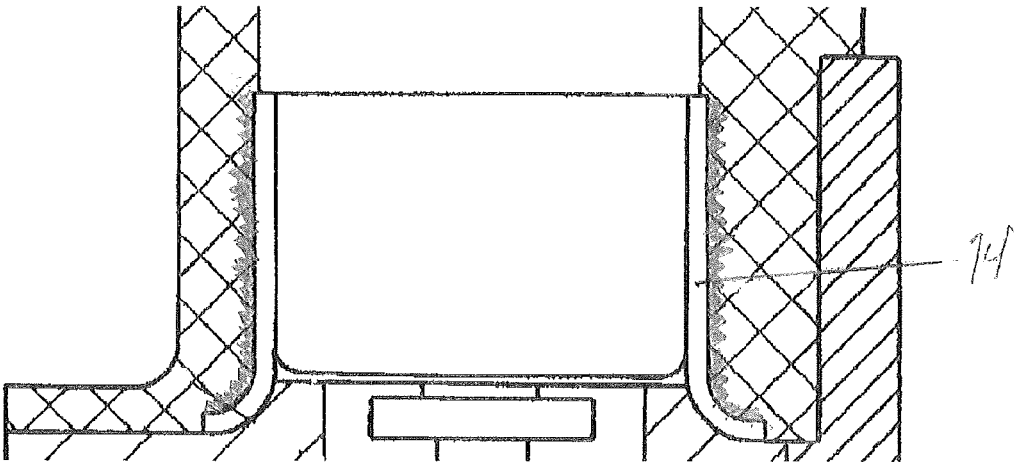
FIG. 3 illustrates an exemplary heat transmission element having a roughened surface according to an embodiment of the present disclosure.

In accordance with an exemplary embodiment, the outer surface of the heat transmission element 14, which is in the form of a cylindrical casing, can be corrugated (FIG. 2) or roughened (FIG. 3).

In accordance with an exemplary embodiment, the heat transmission element, which is in the form of a cylindrical casing, can be composed of metal, e.g., copper or a copper alloy, aluminum or an aluminum alloy, etc., or can be composed of a ceramic which is sufficiently thermally conductive for this purpose.

In accordance with an exemplary embodiment, the heat transmission element, which is in the form of a cylindrical casing, can be composed of an electrically conductive plastic (filled or else unfilled). Partial layers can be electrically insulating. This arrangement makes it possible to produce a thermal conductivity gradient.

Figure 4:
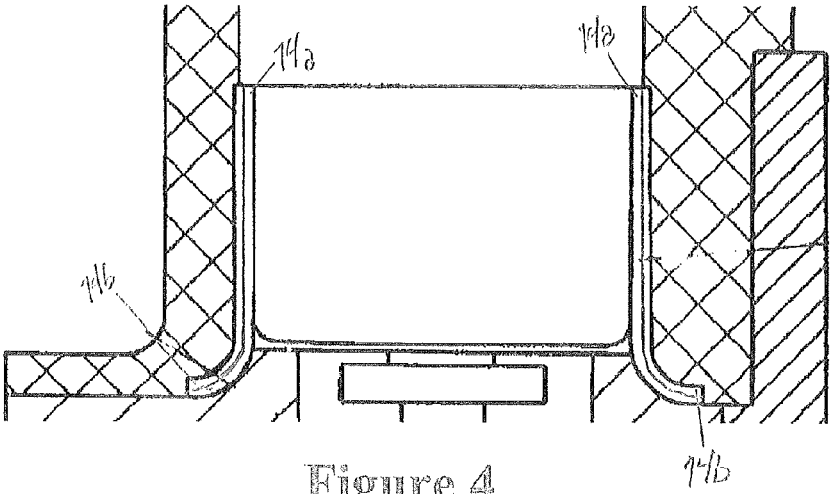
FIG. 4 illustrates an exemplary heat transmission element formed in layers according to an embodiment of the present disclosure.

In accordance with an exemplary embodiment, the heat transmission element 14, which is in the form of a cylindrical casing, can be formed in layers from a two-component material, in which an outer material component has a high thermal conductivity, and an inner material component has a lower thermal conductivity (FIG. 4).

Exemplary embodiments of the present disclosure also provide a method for producing such a pole part such, in which the vacuum interrupter chamber and/or the respective contact holder is provided with a heat transmission element before being encapsulated in an external encapsulation casing. The heat transmission element, which is in the form of a cylindrical casing, is fitted to the outer surface of the vacuum interrupter chamber and is then also surrounded or extrusion coated with the encapsulation casing compound.

FIG. 1 illustrates an exemplary pole part used in a medium-voltage or high-voltage switchgear assembly, according to an embodiment of the present disclosure. A vacuum interrupter chamber 10 is arranged within the pole part. At least one moving contact, and if required a stationary contact, are arranged in the vacuum interrupter chamber 10.

According to an exemplary embodiment, the vacuum interrupter chamber 10 can be embedded in an encapsulation casing 20. According to an exemplary embodiment, the encapsulation casing can be formed from either (i) an epoxy-resin encapsulation (e.g., plastic injection molding or press molding), or (ii) an encapsulation compound (e.g., polyurethane, silicone, etc.).

The material of the vacuum interrupter chamber 10 can be composed of ceramic, for example, and metallic covers are also integrated in the pole part to cover both ends of the vacuum interrupter chamber 10. In order to dissipate heat to outside the pole part, on the one hand the casing surface of the encapsulation material and on the other hand a heat transmitter 1, 2 in the form of a heat sink are provided. According to an exemplary embodiment, the heat transmitter 1, 2 can be arranged, for example, on or adjacent to a pole part and provided from the outside.

The thermal flow coming from the inside must, however, first of all be passed outwards. The heat transmission element 14 according to the disclosure, which can be in the form of a cylindrical casing, can be and is used for this purpose. The heat transmission element can be also encapsulated in the pole part in the form of a thermally conductive metal sheet or a film.

According to an exemplary embodiment, the heat transmission element 14 can be composed of metal, or of a plastic material which has adequate thermal conductivity for the intended purpose.

According to an exemplary embodiment, the heat transmission element 14 may also be formed from a multilayer composite material composed of electrically conductive and electrically insulating plastic, or from a metallically coated plastic, for example. The heat transmission element 14 may also be produced using the press-molding or injection-molding process, and can then be introduced as normal at the appropriate point.

According to an exemplary embodiment, the heat transmission element 14 can be encapsulated directly in a pole part (even without any gap).

FIG. 1 shows the manufacture of a pole part with a heat transmission element 1, 2, 14. In the example shown in the drawing, two heat transmission elements 1, 2, 14 are illustrated. The heat transmission element(s) can be composed of sheet copper, thus resulting in the capability to pass the heat from the contact connecting piece (e.g., external contact(s) 12, 13) via a component of, for example, a vacuum interrupter chamber 10 to the ceramic material of the vacuum interrupter chamber 10. The aim is "large-area" distribution of the heat created at the contact connection to the cast-resin component for heat dissipation to the exterior by convection.

Furthermore, the thermal conductivity of the vacuum interrupter chamber ceramic ($Al_2O_3$) is higher than that of ($SiO_2$) (low-cost epoxy filler) and likewise carries the thermal flow further in an appropriate form, thus making it possible to transmit a greater energy flow from the pole part to the surrounding area.

According to the above-described exemplary embodiments, there is considerable improvement in the area of heat transmission as well as in the encapsulation technology. In addition, a completely closed pole part can be produced with heat transmission elements 1, 2, 14 in one step. This can be done using either casting and casting-resin technology or else injection-molding technology, for example. According to an exemplary embodiment, the heat transmission element 14 can be provided before the vacuum interrupter chamber 10 is encapsulated in an external encapsulation casing. The heat transmission element 14 can then be fitted to an outer surface of the vacuum interrupter chamber 10 and can then be surrounded or extrusion coated with the compound of the encapsulation casing 20.

The exemplary embodiments described above lead to a considerable reduction in the component costs for the heat transmission element 14, since the heat transmission element 14 does not need to be produced from a "metal block" composed of copper or aluminum, but from sheet metal or film, or as an injection-molded component, for example.

Considerably more complex heat transmission element geometries can be achieved, thus improving the heat transmission by convection.

The heat transmission element 14 may be composed of two different materials, production using the following two-component process: a plastic 1 with a relatively high thermal conductivity (for example also electrically conductive) is first extrusion coated with a material 2 with a lower thermal conductivity (with a plastic, for example, also electrically non-conductive). It is also possible to produce the material 1 from a plastic with low conductivity (unfilled or filled) and the material 2 from a more conductive plastic.

The heat transmission element may also be provided with a plastic coating, for dielectric reasons. This is not required for heat transmission elements which are designed to be "electrically insulating". In this case, the plastic can be filled with C, $Al_2O_3$ or else with AlN, for example.

This allows heat transmission elements to be fitted both to the fixed-contact mount area and in the switching contact area of a pole part, to be screwed on, and/or to be completely encapsulated as well. Comparatively compact pole parts can thus be produced using encapsulation technology, and are suitable for a high rated current.

If heat transmission elements 1, 2, 14 are used, then the weight of the overall component can likewise be reduced. Furthermore, the heat transmission elements 1, 2, 14 can also be used in areas adjacent to the flexible strip or a moving current transmission piston (or the corresponding socket), with little influence on the mechanical behavior of the component. For instance, in the illustrated example, an inner surface of the heat transmission element 14 rests on or is in the vicinity of an outer surface of the vacuum interrupter chamber 10 and a contact holder (e.g., external contact 12, 13), and an outer surface of the heat transmission element 14 rests on an inner surface of the encapsulation casing 20 or is located within the encapsulation casing 20.

If a conductive foil or a strip (also formed from two or more layers) is inserted into the pole part, then the heat can be transmitted "over a large area" to the pole part. Overall, this allows a greater energy flow to be transmitted outwards to the surrounding area.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A pole part of a switchgear assembly, comprising:

a vacuum interrupter chamber, which is encapsulated in an external encapsulation casing, is composed of a composite material, and is closed at both ends by metallic cover elements;

a contact holder; and a thermally conductive heat transmission element in the form of a cylindrical casing, the heat transmission element having an inner surface and an outer surface, and the heat transmission element being provided between the vacuum interrupter chamber, the contact holder and the encapsulation casing, wherein along a length of the inner surface the heat transmission element rests on or is in a vicinity of an outer surface of the vacuum interrupter chamber and the contact holder, and along a length of the outer surface of the heat transmission element rests on an inner surface of the encapsulation casing.

2. The pole part as claimed in claim 1, wherein the outer surface of the heat transmission element, which is in the form of a cylindrical casing, is folded.

3. The pole part as claimed in claim 1, wherein the outer surface of the heat transmission element, which is in the form of a cylindrical casing, is corrugated.

4. The pole part as claimed in claim 1, wherein the outer surface of the heat transmission element, which is in the form of a cylindrical casing, is roughened.

5. The pole part as claimed in claim 1, wherein the heat transmission element, which is in the form of a cylindrical casing, is composed of metal.

6. The pole part as claimed in claim 1, wherein the heat transmission element, which is in the form of a cylindrical casing, is composed of aluminum or an aluminum alloy.

7. The pole part as claimed in claim 1, wherein the heat transmission element, which is in the form of a cylindrical casing, is composed of a thermally conductive plastic.

8. The pole part as claimed in claim 1, wherein the heat transmission element, which is in the form of a cylindrical casing, is formed in layers constituted by an outer material component and an inner material component, wherein the outer material component has a high thermal conductivity than the inner material component.

9. A method for producing a pole part of a switchgear assembly having a vacuum interrupter chamber, which is encapsulated in an external encapsulation casing, is composed of a composite material, and is closed at both ends by metallic cover elements, the method comprising:

arranging a heat transmission element on the vacuum interrupter chamber before the vacuum interrupter chamber is encapsulated in the external encapsulation casing, wherein the arranging of the heat transmission element comprises fitting the heat transmission element along a length of an outer surface of the vacuum interrupter chamber, and surrounding or extrusion coating a length of an outer surface of the fitted heat transmission element with the encapsulation casing compound.

10. A method for producing a pole part of a switchgear assembly having a vacuum interrupter chamber, which is encapsulated in an external encapsulation casing, is composed of a composite material, and is closed at both ends by metallic cover elements, the method comprising:

producing a heat transmitter composed of a thermally conductive plastic using at least one of an injection-molding, casting and molding compound process; and applying the produced heat transmitter to the pole part by fitting the heat transmission element along a length of the vacuum interrupter chamber and coating the heat transmitter with the encapsulation casing compound.

11. The method as claimed in claim 10, comprising:

applying the heat transmitter to the pole part by connecting the heat transmitter to the pole part via an adhesive, to produce an electrically conductive joint therebetween.

12. The method as claimed in claim 10, comprising:

applying the heat transmitter to the pole part by connecting the heat transmitter to the pole part via a screw connection with one or more inner components, via screw unions.

13. The method as claimed in claim 10, comprising:

applying the heat transmitter to the pole part by connecting the pole part to the pole part via a sealing device, to produce an electrically conductive joint therebetween.

14. The pole part as claimed in claim 2, wherein the heat transmission element, which is in the form of a cylindrical casing, is composed of one of a metal, a metal alloy and a thermally conductive plastic.

15. The pole part as claimed in claim 3, wherein the heat transmission element, which is in the form of a cylindrical casing, is composed of one of a metal, a metal alloy and a thermally conductive plastic.

16. The pole part as claimed in claim 4, wherein the heat transmission element, which is in the form of a cylindrical casing, is composed of one of a metal, a metal alloy and a thermally conductive plastic.

17. The pole part as claimed in claim 2, wherein the heat transmission element, which is in the form of a cylindrical casing, is formed in layers constituted by an outer material component and an inner material component, wherein the outer material component has a high thermal conductivity than the inner material component.

18. The pole part as claimed in claim 3, wherein the heat transmission element, which is in the form of a cylindrical casing, is formed in layers constituted by an outer material component and an inner material component, wherein the outer material component has a high thermal conductivity than the inner material component.

19. The pole part as claimed in claim 4, wherein the heat transmission element, which is in the form of a cylindrical casing, is formed in layers constituted by an outer material component and an inner material component, wherein the outer material component has a high thermal conductivity than the inner material component.

20. The pole part as claimed in claim 1, wherein the switchgear assembly is at least one of a low-voltage, medium-voltage and high-voltage switchgear assembly.

21. The method as claimed in claim 9, wherein the switchgear assembly is at least one of a low-voltage, medium-voltage and high-voltage switchgear assembly.

22. The method as claimed in claim 9, wherein the heat transmission element is the form of a cylindrical casing, and wherein the arranging of the heat transmission element comprises:

arranging the heat transmission element such that an inner surface of the heat transmission element rests on or in the vicinity of an outer surface of the vacuum interrupter chamber; and surrounding or extrusion coating the fitted heat transmission element with the encapsulation casing compound such that an outer surface of the heat transmission element rests on an inner surface of the encapsulation casing inner surface or is located within the encapsulation casing.

23. The method as claimed in claim 10, wherein the applying of the heat transmitter comprises:

after encapsulation, screwing the heat transmitter through openings to the pole part; and filling the openings to the pole part with a filler.

24. The method as claimed in claim 10, wherein the applying of the heat transmission element comprises:

fitting the heat transmission element to an outer surface of the vacuum interrupter chamber.

25. The method as claimed in claim 10, wherein the vacuum interrupter chamber is equipped with at least one of ceramic insulators and glass insulators.

26. The method as claimed in claim 10, wherein the sealing device includes at least one of an O-ring and a flat-ring seal.

27. The method as claimed in claim 10, wherein the switchgear assembly is at least one of a low-voltage, medium-voltage and high-voltage switchgear assembly.

* * * * *